US009631498B2

(12) United States Patent
Yokoyama

(10) Patent No.: US 9,631,498 B2
(45) Date of Patent: Apr. 25, 2017

(54) GAS TURBINE BLADE

(71) Applicant: Mitsubishi Hitachi Power Systems, Ltd., Kanagawa (JP)

(72) Inventor: Takashi Yokoyama, Tokyo (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 244 days.

(21) Appl. No.: 13/622,747

(22) Filed: Sep. 19, 2012

(65) Prior Publication Data

US 2013/0071255 A1 Mar. 21, 2013

(30) Foreign Application Priority Data

Sep. 20, 2011 (JP) ..... 2011-204050

(51) Int. Cl.
*F01D 5/18* (2006.01)

(52) U.S. Cl.
CPC ..... *F01D 5/186* (2013.01); *F05D 2240/303* (2013.01)

(58) Field of Classification Search
CPC ..... F01D 5/18; F05D 2240/303
USPC ..... 415/115; 416/97 R
See application file for complete search history.

(56) References Cited

U.S. PATENT DOCUMENTS 4,923,371 A * 5/1990 Ben-Amoz ..... 416/97 R
6,325,593 B1 * 12/2001 Darkins, Jr. ..... F01D 5/186 415/115
6,955,522 B2 10/2005 Cunha et al.
7,246,992 B2 * 7/2007 Lee ..... 415/115
7,469,739 B2 * 12/2008 Otero et al. ..... 164/516
8,066,482 B2 * 11/2011 Strohl ..... F01D 5/186 415/115
2006/0056969 A1 3/2006 Jacala et al.

FOREIGN PATENT DOCUMENTS

JP 7-63002 A 3/1995
JP 2004-308658 A 11/2004
JP 2006-83851 A 3/2006
JP 2006-207586 A 8/2006

OTHER PUBLICATIONS

Anisotropy of Nickel-Base Superalloy Single Crystals, MacKay et al., NASA, 1980.*
Japanese Office Action with partial English translation dated Oct. 22, 2013 (four (4) pages).

* cited by examiner

*Primary Examiner* — Woody Lee, Jr.
(74) *Attorney, Agent, or Firm* — Crowell & Moring LLP

(57) ABSTRACT

A gas turbine blade having a film cooling structure can reduce stress and strain that occur around the cooling holes of the film cooling structure. For example, in the gas turbine blade, a plurality of cooling holes thoroughly connected to the cooling pass formed inside the gas turbine blade are arranged in the span direction in the leading edge portion of the gas turbine blade, and the direction of the longitudinal axis of the cooling holes is made identical to the direction of principal strain occurring in the leading edge portion of the turbine blade within a range of 15 degrees.

6 Claims, 7 Drawing Sheets

GAS TURBINE BLADE

CLAIM OF PRIORITY

The present application claims priority from Japanese Patent application serial No. 2011-204050, filed on Sep. 20, 2011, the content of which is hereby incorporated by reference into this application.

TECHNICAL FIELD

The present invention relates to a gas turbine blade with film cooling holes.

BACKGROUND ART

Efficiency of a gas turbine increases as the temperature of the combustor outlet or the temperature of the turbine inlet increases. However, the temperature of the combustor outlet of gas turbines in current use reaches 1,500° C., and the temperature of the gas turbine blade surface which is exposed to high-temperature combustion gas exceeds the critical temperature of the heat-resistant alloy used. Therefore, it is necessary to cool the gas turbine blades.

To do so, compressed air is provided from a compressor to a cooling pass formed inside the gas turbine blade and convection cooling of the cooling pass wall takes place. Also, film cooling is performed in such a way that a plurality of through-holes are provided on the surface of the gas turbine blade and air is ejected therethrough from the cooling pass onto the surface of the gas turbine blade and flown on the entire surface. Thus, the increase in the temperature of the gas turbine blade is suppressed to a point lower than the critical temperature.

With regard to the film cooling structure, elliptically-shaped holes have been proposed (e.g., patent literature 1 and patent literature 2) with the intention of forming a layer of cooling air on the entire surface of the gas turbine blade.

CITATION LIST

Patent Literature

[PTL 1]
Japanese Unexamined Patent Application Publication No. Hei 7 (1995)-63002
[PTL 2]
Japanese Unexamined Patent Application Publication No. 2006-83851

SUMMARY OF INVENTION

Technical Problem

Although the advantageous effect of the above technique to suppress the increase in the temperature of the surface of the gas turbine blade is expected, there is a temperature difference between the surface of the gas turbine blade and the surface of the internal cooling pass. Consequently, a thermal expansion difference is created between the surface of the gas turbine blade and the surface of the cooling pass. As a result, on the average, compressive stress occurs on the surface of the gas turbine blade and tensile stress occurs on the surface of the cooling pass.

In particular, since stress concentrates in the film cooling structure with a plurality of through-holes, there is a possibility that stress corresponding to yield stress of the material and plastic strain may occur. Patent literature 2 describes that elliptical holes reduce the concentration of stress. However, depending on the relation between the stress field and the axis of the ellipse, stress concentration is not always reduced.

The objective of the present invention is to provide a gas turbine blade capable of suppressing stress concentration in the film cooling structure with through-holes as well as reducing stress and strain that occur around the holes.

Solution to Problem

To achieve the above objective, the present invention is a gas turbine blade with film cooling holes through which a cooling medium is ejected onto the outer surface over which high-temperature gas flows; and the gas turbine blade is configured such that the direction of the longitudinal axis of the film cooling hole coincides, within a range of 15 degrees, with the direction of the principal strain in the film cooling hole that has been calculated by means of the heat transfer analysis and the structural analysis using a finite element analysis model of the gas turbine blade for which boundary conditions have been set based on the operating conditions of the gas turbine.

Advantageous Effects of Invention

According to the present invention, it is possible to provide a gas turbine blade capable of suppressing stress concentration in the film cooling structure with through-holes as well as reducing stress and strain that occur around the holes.

Problems, configurations, and advantageous effects other than the above will be clarified by the description of the following embodiments.

DESCRIPTION OF EMBODIMENTS

Figure 1:
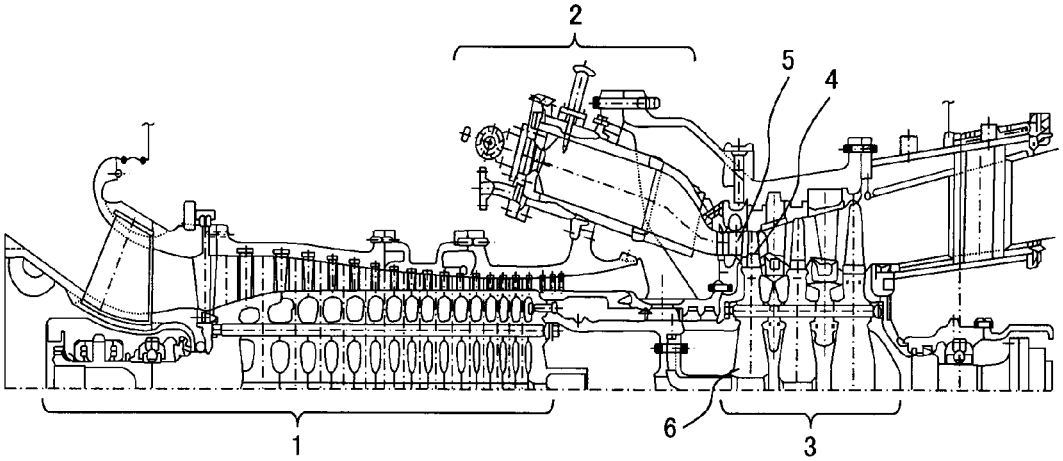
FIG. 1 illustrates an example of a structure of a representative gas turbine.
Figure 2:
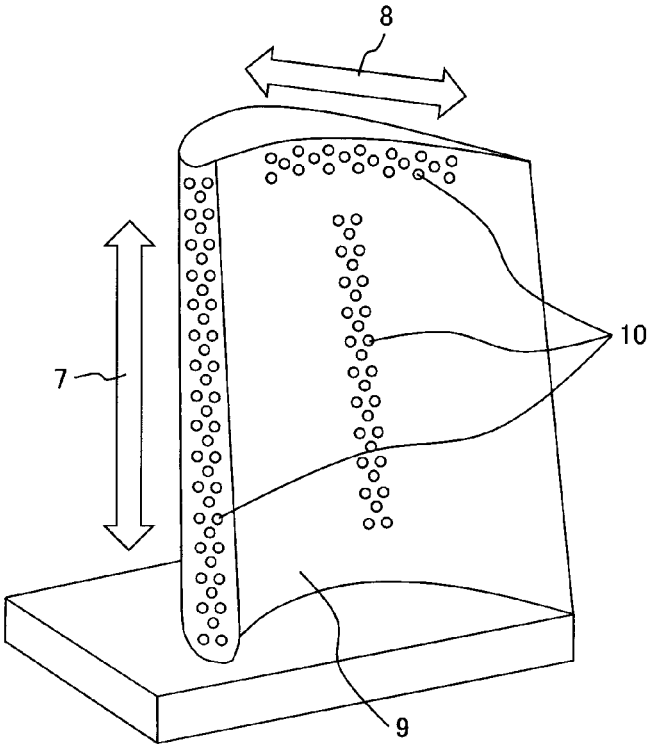
FIG. 2 illustrates an example of a structure of a gas turbine blade with film cooling holes.
Figure 3A:
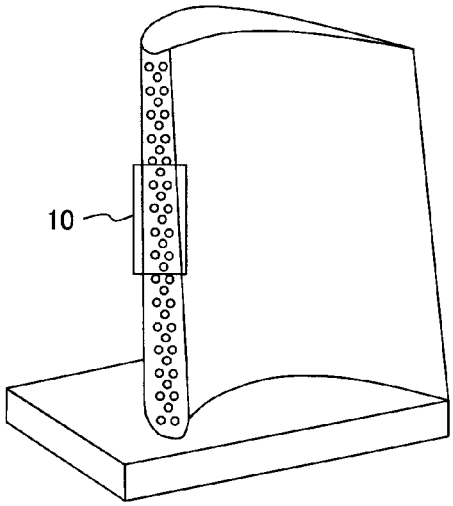
FIG. 3A illustrates a method of configuring cooling holes in embodiment 1 of the present invention, and is a perspective view of the gas turbine blade with cooling holes provided in the leading edge portion of the turbine blade.
Figure 3B:
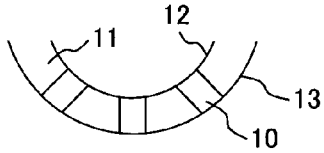
FIG. 3B illustrates a method of configuring cooling holes in embodiment 1 of the present invention, and is a cross-sectional view of the leading edge portion of the gas turbine blade in FIG. 3A.
Figure 3C:
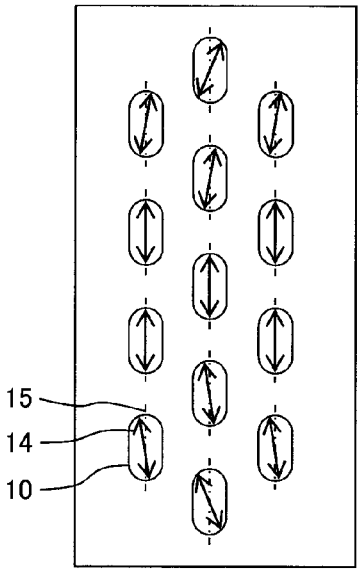
FIG. 3C illustrates a method of configuring cooling holes in embodiment 1 of the present invention, and is an enlarged view of the surface of the cooling pass located in the leading edge portion, given to explain the shape of the cooling holes and the arrangement of the holes on the gas turbine blade in FIG. 3A.
Figure 3D:
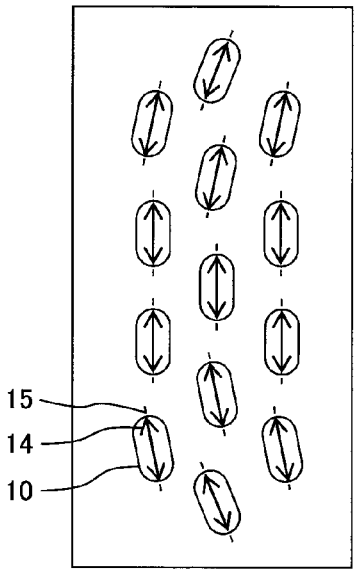
FIG. 3D illustrates a method of configuring cooling holes in embodiment 1 of the present invention, and is an enlarged view of the surface of the cooling pass located in the leading edge portion, given to explain a modification of the arrangement of the cooling holes provided on the gas turbine blade in FIG. 3A.

FIG. 1 is a typical structural cross-sectional view of a gas turbine, and FIG. 2 illustrates a structural example of a gas turbine blade with cooling holes.

A gas turbine roughly comprises a compressor 1, a combustor 2, and a turbine 3. The compressor 1 adiabatically compresses air taken from the atmosphere as an operating fluid. The combustor 2 mixes a fuel with the compressed air supplied from the compressor 1 and burns the mixture thereby generating a high-temperature and high-pressure gas. The turbine 3 generates rotational motive power when the combustion gas introduced from the combustor 2 expands. Exhaust gas from the turbine 3 is discharged into the atmosphere.

The common structure is that moving blades (rotor blades) 4 and nozzles (stator blades) 5 of a gas turbine are alternately disposed and installed in the groove provided on the outer circumference side of the wheel 6.

To increase efficiency, gas turbines tend to be exposed to increasingly high temperature. Since the temperature of the surface of the gas turbine blades exposed to high-temperature combustion gas exceeds the critical temperature of the heat-resistant alloy used, it is necessary to cool the gas turbine blades. One of the gas turbine blade cooling methods is that air from the middle stage or the outlet of the compressor 1 is introduced into the cooling pass created inside the blade, and cooling is performed by means of convection heat transfer from the cooling pass wall. Another cooling method is that, as illustrated in FIG. 2, cooling holes 10 that connect the blade body 9 to the cooling pass located inside the blade are provided, and film cooling is performed by ejecting cooling air from the cooling holes so that the cooling air will cover the entire surface of the turbine blade.

During the starting-up, steady-state, and stop cycles of the gas turbine, convection cooling generates a temperature difference between the outer surface of the blade and the cooling pass wall, causing thermal stress to occur. Also, on the gas turbine moving blade, the stress distribution becomes complicated because centrifugal stress superposes. Furthermore, since stress concentrates in the film cooling holes, when a plurality of cooling holes are continuously provided, it is necessary to choose a method that will not generate excess stress or strain.

In the future, gas turbines will be required to cope with higher temperatures, which leads us to expect that the combustion temperature will further increase and that the number of cooling holes will also increase. Therefore, more reliable gas turbine blades are required.

Hereafter, embodiments of the present invention will be described with reference to the drawings.

FIG. 3 illustrates a method of configuring cooling holes in the leading edge portion of the gas turbine blade (moving blade), which clearly illustrates the characteristics of the present invention. As illustrated in FIG. 3A, a plurality of cooling holes 10 are provided in the leading edge portion 11 of the gas turbine blade from the root of the blade toward the tip of the blade. As illustrated in the cross-sectional view of the leading edge portion in FIG. 3B, the cooling holes 10 are thoroughly connected to the cooling pass formed inside the gas turbine blade. As illustrated in the enlarged view of the surface of the cooling pass located in the leading edge portion in FIG. 3C, this embodiment is characterized in that the curvature radius of the curve (hole) whose tangent line is a line in the direction of the longitudinal axis of the cooling holes 10 arranged in the leading edge portion 11 of the gas turbine blade in the span direction (a line parallel to the longitudinal axis) is greater than the curvature radius of the curve (hole) whose tangent line is a line in the direction of the minor axis (a line parallel to the minor axis); and the direction of the longitudinal axis 15 and the direction of the principal strain 14 in the leading edge portion 11 of the gas turbine blade coincide within a range of 15 degrees. As the arrow 14 illustrates, tensile stress and strain components are generated mainly in the span direction on the surface of the cooling pass in the leading edge portion of the gas turbine blade. Therefore, if the direction of the principal strain 14 is within a range of 15 degrees from the span direction, it is possible to reduce the stress and strain, when compared with cases where the cooling hole is circular, by making the span direction identical to the direction of the longitudinal axis of the cooling hole. Furthermore, as illustrated in FIG. 3D, it is possible to minimize stress and strain by changing the direction of the longitudinal axis 15 of the cooling hole 10 according to the change of the direction of the principal strain 14. Specifically in the gas turbine blade, the temperature of the central portion of the leading edge portion 11 of the gas turbine blade tends to become especially high, and great compressive and tensile strain occurs during the gas turbine operating cycle due to the temperature difference from the cooling pass. Accordingly, this embodiment can effectively reduce the strain occurring in the film cooling structure and contribute to the prolonged service life of the gas turbine blade.

Figure 4:
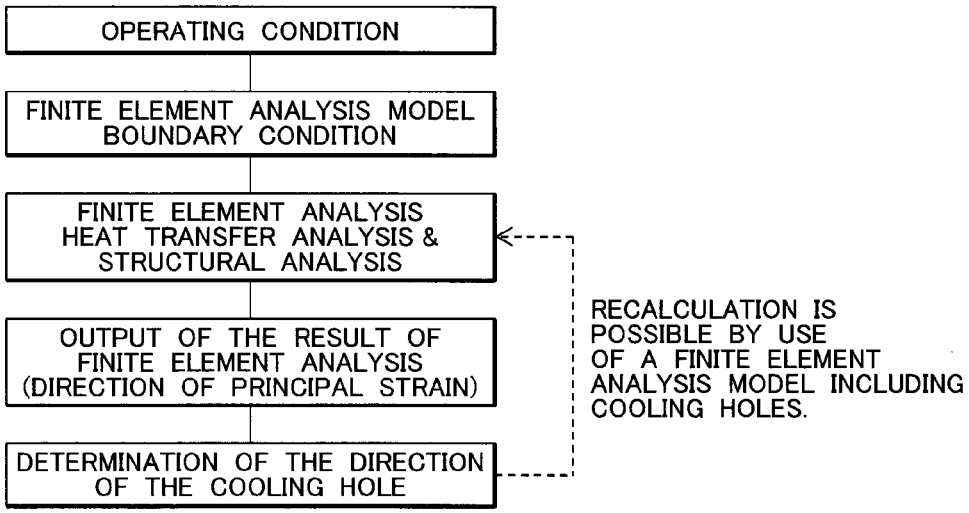
FIG. 4 illustrates the procedure for implementing embodiment 1 of the present invention.
Figure 5:
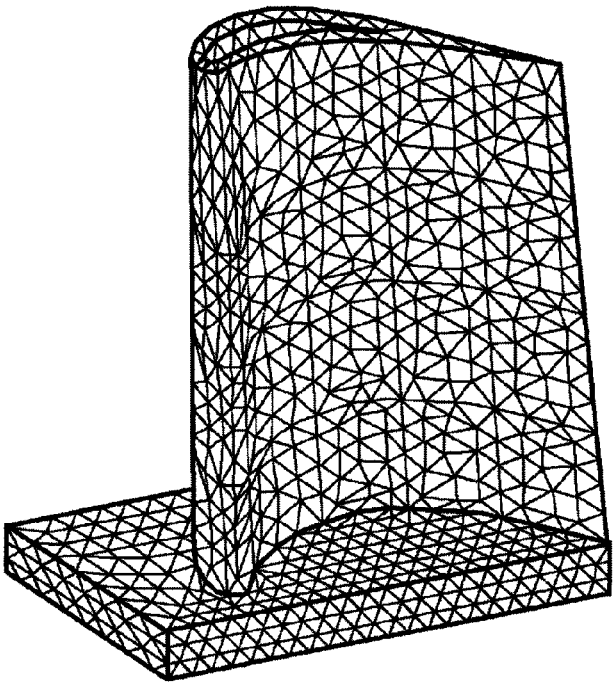
FIG. 5 illustrates a finite element analysis model of the gas turbine blade (moving blade).

FIG. 4 illustrates the procedure for implementing this embodiment. It is possible to calculate the direction of the principal strain occurring in the film cooling structure by means of the heat transfer analysis and the structural analysis using a finite element analysis model of a gas turbine blade with boundary conditions specified based on the operating conditions of the gas turbine. The boundary conditions can be specified based on the actual measurements of conventional machines or by thermal fluid calculation based on the operating conditions. The finite element analysis model may be a single gas turbine blade without cooling holes. FIG. 5 illustrates the finite element analysis model of a gas turbine blade (moving blade). Boundary conditions used in the finite element analysis model are as follows: the heat transfer analysis uses thermal conditions including gas temperature, heat transfer coefficient, and heat radiation coefficient; and the structural analysis uses loading conditions including pressure, centrifugal force, acceleration, and physical temperature obtained by the heat transfer analysis. By calculating the direction of the principal strain under those boundary conditions, it is possible to determine the direction of the longitudinal axis of the cooling hole. The number of cooling holes, their dimensions, and their arrangement can be separately determined from a viewpoint of cooling performance.

After the configuring of the cooling holes has been completed, it is also possible to adjust the direction of the longitudinal axis of the cooling hole by creating a finite element analysis model of a single gas turbine blade including the cooling holes and calculating the direction of the principal strain occurring in the film cooling structure by means of a heat transfer analysis and a structural analysis.

Figure 6:
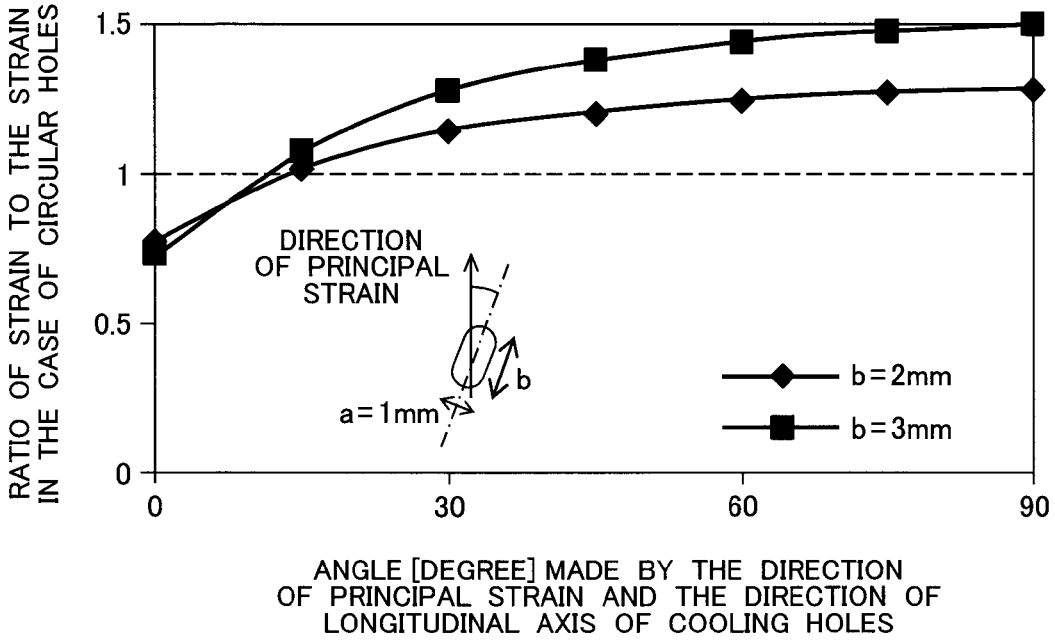
FIG. 6 illustrates the relation between the direction of the longitudinal axis of the cooling hole and the strain.

FIG. 6 illustrates the relation between the shape of the hole and the elastic strain concentration factor that has been obtained by means of a finite element analysis in which a hole is created in the nickel-base superalloy flat plate used for the gas turbine blade and an in-plane tensile displacement load is applied. The shape of the hole is circular or elongate, and the direction of the longitudinal axis of the elongate hole is 0 degrees, 15 degrees, 30 degrees, 45 degrees, 60 degrees, 75 degrees, and 90 degrees to the direction of the load. The vertical axis plots the ratio of the elastic strain concentration factor when the shape of the hole is elongate to the elastic strain concentration factor when the shape of the hole is circular. When the hole is circular, the elastic strain concentration factor is constant regardless of the direction of the principal strain. Therefore, the elastic strain concentration factor becomes lowest when the direction of the longitudinal axis matches the direction of the load; and as the angle difference increases, the elastic strain concentration factor also increases. When the ratio of the longitudinal axis to the minor axis is twice, if the angle difference is approximately 15 degrees or greater, a strain greater than that in the circular hole is generated.

In this embodiment, the gas turbine blade is constructed in such a way that the curvature radius of the cooling hole that comes in contact with the direction of the longitudinal axis is greater than the curvature radius of the cooling hole that comes in contact with the direction of the minor axis, and that the direction of the longitudinal axis matches the direction of the principal strain within a range of 15 degrees. Thus, according to this embodiment, it is possible to suppress the occurrence of cracks starting from a film cooling hole and enables the prolonged service life of the gas turbine blade.

Furthermore, in cases where cooling holes 10 are arranged, in the span direction, in the trailing edge portion of the gas turbine blade where principal strain occurs in the span direction in the same manner as the leading edge portion 11 of the gas turbine blade, it is also possible to set the direction of the longitudinal axis of the cooling hole 10 based on the same concept. Thus, the same advantageous effects as those of the cases where cooling holes are arranged in the leading edge portion of the blade can be obtained.

According to this embodiment, concentration of stress in the direction of the principal strain in the film cooling structure can be suppressed and stress and strain can be reduced. When the shape of the hole is elongate, in the condition where the direction of the principal strain coincides with the direction of the longitudinal axis (the angle made by the direction of principal strain and the direction of the longitudinal axis is 0 degrees), the stress concentration coefficient with regard to the load in the direction of the longitudinal axis reduces as the ratio of the longitudinal length to the minor axis length increases; the stress concentration coefficient approaches asymptotically to 0.6 times the stress concentration coefficient when the shape of the hole is circular. Thus, it is possible to suppress the occurrence of cracks starting from a film cooling hole and enables the prolonged service life of the gas turbine blade.

Figure 7A:
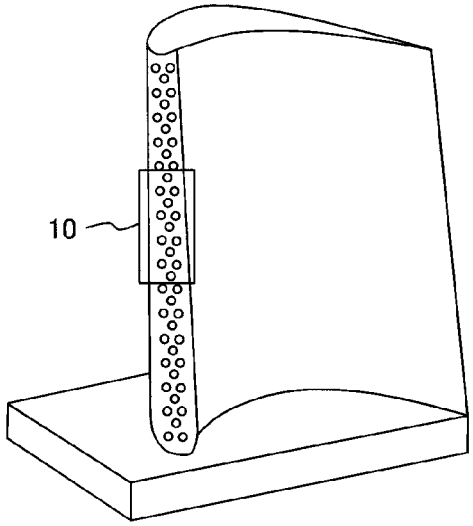
FIG. 7A illustrates embodiment 2 of the present invention, and is a perspective view of the gas turbine blade with cooling holes provided in the leading edge portion of the turbine blade.
Figure 7B:
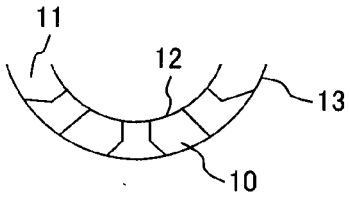
FIG. 7B illustrates embodiment 2 of the present invention, and is a cross-sectional view of the leading edge portion of the blade when the area of cooling holes provided on the gas turbine blade in FIG. 7A changes discontinuously.
Figure 7C:
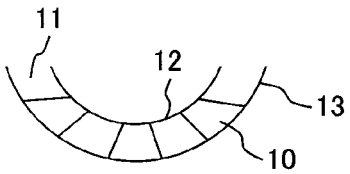
FIG. 7C illustrates embodiment 2 of the present invention, and is a cross-sectional view of the leading edge portion of the blade when the area of cooling holes provided on the gas turbine blade in FIG. 7A changes continuously.

FIG. 7A to FIG. 7C illustrate cooling holes in the leading edge portion of the turbine blade, which is embodiment 2 of the present invention. Embodiment 2 is characterized in that the direction of the longitudinal axis of the cooling holes 10 arranged in the span direction in the leading edge portion 11 of the gas turbine blade coincides with the direction of the principal strain occurring in the leading edge portion of the gas turbine blade; the curvature radius of the hole that comes in contact with the direction of the longitudinal axis is made greater than the curvature radius of the hole that comes in contact with the direction of the minor axis; and the area of holes on the outer surface 13 of the gas turbine blade is greater than the area of holes on the surface of the cooling pass 12. As illustrated in FIG. 7B, the area of holes may be increased discontinuously from the surface of the cooling pass toward the surface of the gas turbine blade. Also as illustrated in FIG. 7C, the area of holes may be increased continuously from the surface of the cooling pass toward the surface of the turbine blade. Furthermore, in this embodiment, as illustrated in FIGS. 7B and 7C, the area of holes is increased along the direction of the mainstream gas flow. By doing so, it is possible to suppress the disturbance of the mainstream gas flow of the gas turbine and efficiently direct the cooling air on the surface of the blade. Therefore, it is possible to reduce the amount of cooling air necessary for keeping the temperature of the surface of the gas turbine blade at a temperature below the allowable temperature and increase the efficiency of the gas turbine.

Figure 8A:
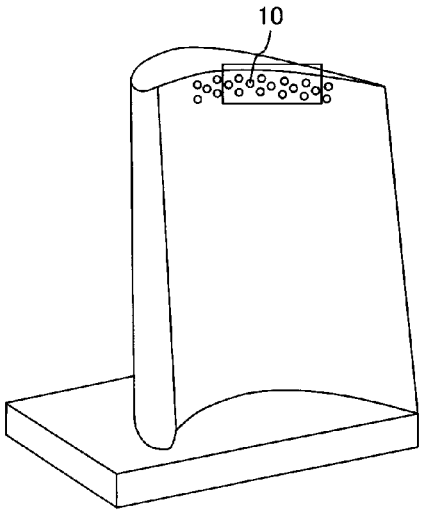
FIG. 8A illustrates embodiment 3 of the present invention, and is a perspective view of the gas turbine blade with cooling holes provided at the tip portion of the turbine blade.
Figure 8B:
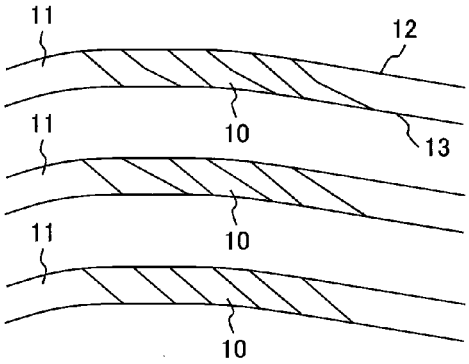
FIG. 8B illustrates embodiment 3 of the present invention, and is a cross-sectional view of the tip portion of the blade, given to explain the method of setting the area of cooling holes provided on the gas turbine blade in FIG. 8A.
Figure 8C:
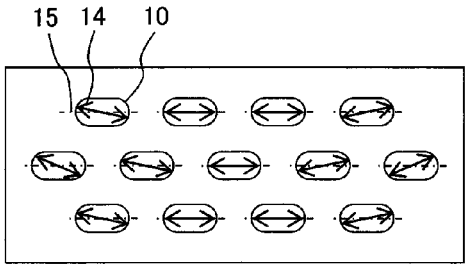
FIG. 8C illustrates embodiment 3 of the present invention, and is an enlarged view of the tip portion of the blade, given to explain the shape of the cooling holes and the arrangement of the holes on the gas turbine blade in FIG. 8A.
Figure 8D:
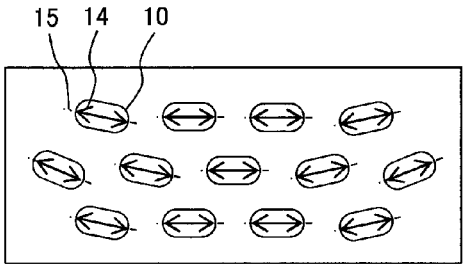
FIG. 8D illustrates embodiment 3 of the present invention, and is an enlarged view of the tip portion of the blade, given to explain a modification of the arrangement of the cooling holes provided on the gas turbine blade in FIG. 8A.

FIG. 8A to FIG. 8D illustrate a method of configuring cooling holes at the tip portion of the gas turbine blade, which is embodiment 3 of the present invention. Embodiment 3 is characterized in that cooling holes 10, arranged in the chord direction at the tip portion of the gas turbine blade as illustrated in FIG. 8A, are thoroughly connected to the cooling pass formed inside the gas turbine blade as illustrated in the cross-sectional view of the tip portion of the turbine blade in FIG. 8B; the curvature radius of the hole that comes in contact with the direction of the longitudinal axis of the cooling hole 10, as illustrated in the enlarged view of the tip portion of the gas turbine blade in FIG. 8C, is made greater than the curvature radius of the hole that comes in contact with the direction of the minor axis; and the direction of the longitudinal axis coincides with the direction of the principal strain occurring at the tip portion of the gas turbine blade within a range of 15 degrees. At the tip portion of the gas turbine blade, stress and strain components occur mainly in the chord direction as indicated by the arrows. Therefore, if the direction of the principal strain is within a range of 15 degrees from the chord direction, it is possible to reduce the stress and strain, when compared with cases where the cooling hole is circular, by making the chord direction identical to the direction of the longitudinal axis of the cooling hole. Furthermore, as illustrated in FIG. 8D, it is possible to minimize the stress and strain by changing the direction of the longitudinal axis of the cooling hole 10 according to the change of the direction of the principal strain. Moreover, cooling holes 10 may be created, as illustrated in the upper stage of FIG. 8B, so that the area of holes increases discontinuously from the surface of the cooling pass 12 toward the outer surface 13 of the gas turbine blade; the cooling holes 10 may be created, as illustrated in the middle stage of FIG. 8B, so that the area of holes continuously increases from the surface of the cooling pass toward the outer surface of the turbine blade; or the cooling holes 10 may be created, as illustrated in the lower stage of FIG. 8B, so that the area of holes on the surface of the cooling pass is substantially identical to the area of holes on the outer surface of the turbine blade.

The tip portion of the gas turbine blade, as well as the leading edge portion 11 of the gas turbine blade, is exposed to especially high temperature. Therefore, great compressive and tensile strain occurs during the operating cycle of the gas turbine due to the temperature difference from the cooling pass. Accordingly, this embodiment can effectively reduce the strain occurring in the film cooling structure and contribute to the prolonged service life of the gas turbine blade.

Furthermore, in cases where cooling holes 10 are arranged in the chord direction at a location other than the tip portion of the gas turbine blade, such as the root portion of the blade or the central portion of the blade, it is also possible to set the direction of the longitudinal axis of the elongate cooling hole 10 based on the same concept described above. Thus, the same advantageous effects as those of the cases where cooling holes are arranged at the tip portion of the blade can be obtained.

Figure 9A:
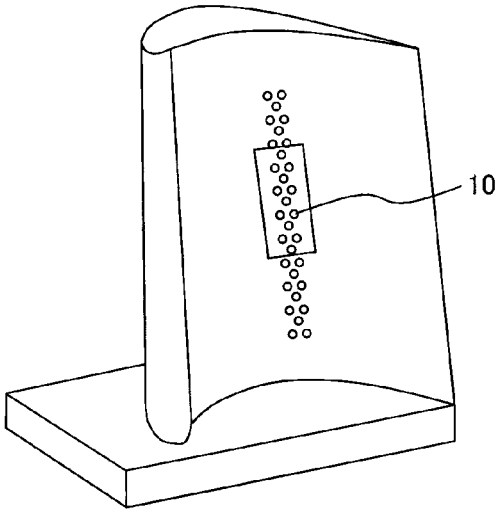
FIG. 9A illustrates embodiment 4 of the present invention, and is a perspective view of the gas turbine blade with cooling holes provided on the pressure side of the blade in the span direction.
Figure 9B:
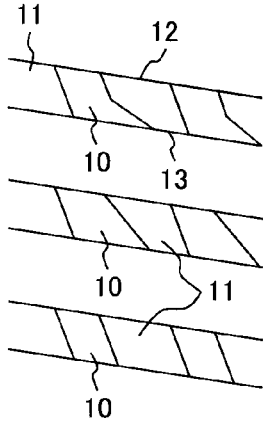
FIG. 9B illustrates embodiment 4 of the present invention, and is a cross-sectional view of the pressure side of the blade, given to explain the method of setting the area of cooling holes provided on the gas turbine blade in FIG. 9A.
Figure 9C:
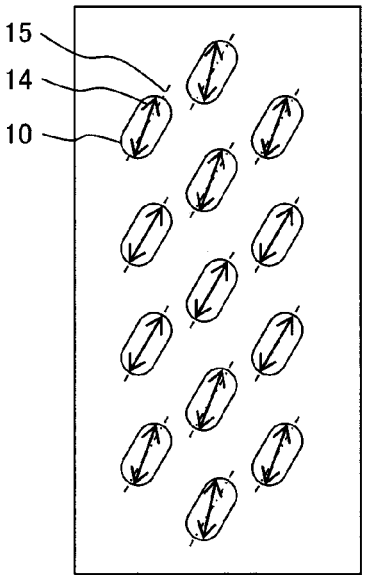
FIG. 9C illustrates embodiment 4 of the present invention, and is an enlarged view of the pressure side of the blade, given to explain the shape of the cooling holes and the arrangement of the holes on the gas turbine blade in FIG. 9A.
Figure 9D:
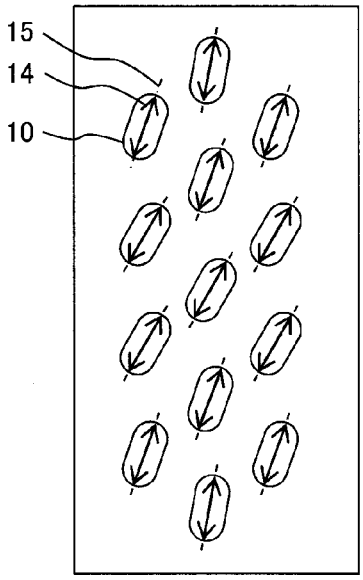
FIG. 9D illustrates embodiment 4 of the present invention, and is an enlarged view of the pressure side of the blade, given to explain a modification of the arrangement of the cooling holes provided on the gas turbine blade in FIG. 9A.

FIG. 9A to FIG. 9D illustrate a method of configuring cooling holes on the pressure side of the gas turbine blade, which is embodiment 4 of the present invention. Embodiment 4 is characterized in that cooling holes 10 arranged in the span direction on the pressure side of the gas turbine blade, as illustrated in FIG. 9A, are thoroughly connected to the cooling pass formed inside the gas turbine blade as illustrated in the cross-sectional view of FIG. 9B; the curvature radius of the hole that comes in contact with the direction of the longitudinal axis of the cooling hole 10 is made greater than the curvature radius of the direction of the minor axis of the hole; and the direction of the longitudinal axis coincides with the direction of the principal strain occurring on the pressure side of the gas turbine blade within a range of 15 degrees as illustrated in the enlarged view of the pressure side of the gas turbine blade in FIG. 9C. Furthermore, as illustrated in FIG. 9D, it is possible to minimize the stress and strain by changing the direction of the longitudinal axis of the cooling hole 10 according to the change of the direction of the principal strain. Moreover, the cooling holes 10 may be created, as illustrated in the upper stage of FIG. 9B, so that the area of holes increases discontinuously from the surface of the cooling pass 12 toward the outer surface 13 of the gas turbine blade; the cooling holes 10 may be created, as illustrated in the middle stage of FIG. 9B, so that the area of holes continuously increases from the surface of the cooling pass toward the outer surface of the turbine blade; or the cooling holes 10 may be created, as illustrated in the lower stage of FIG. 9B, so that the area of holes on the surface of the cooling pass is substantially identical to the area of holes on the outer surface of the turbine blade. Moreover, in the embodiments illustrated in FIG. 8 and FIG. 9, description is made about the cooling holes set up on the pressure side of the gas turbine rotor blade. However, the same configuration can be applied to the cases where cooling holes are set up on the suction side of the turbine blade.

In the above-mentioned embodiments, a gas turbine moving blade (rotor blade) where cooling holes are set up has been described. However, the same configuration can be applied to the gas turbine nozzle (stator blade) with cooling holes.

When the above configurations are applied to a gas turbine blade made of a material having anisotropy, a finite element analysis is implemented by use of material characteristics that take into account the anisotropy.

Furthermore, the present invention is not intended to be limited to the above embodiments, but a variety of modifications are included. For example, detailed descriptions are given about the above embodiments to clearly explain the present invention; and the present invention is not intended to be limited to a gas turbine blade having all of the described configurations. It is possible to replace a part of the configuration of one embodiment with the configuration of another embodiment; and it is also possible to add a configuration of one embodiment to the configuration of another embodiment. Furthermore, with regard to a part of the configuration of each embodiment, it is possible to add a configuration of another embodiment, delete or replace a part of the configuration.

REFERENCE SIGNS LIST

1: compressor
2: combustor
3: turbine
4: moving blade
5: nozzle
6: wheel
7: load in the span direction
8: load in the chord direction
9: blade body
10: cooling hole
11: leading edge portion of the gas turbine blade
12: surface of the cooling pass
13: outer surface of the gas turbine blade

The invention claimed is:

1. A method of configuring film cooling holes through which a cooling medium is ejected onto an outer surface of a gas turbine blade, comprising the steps of:

calculating a direction of principal strain in the film cooling holes by means of a heat transfer analysis and a structural analysis using a finite element analysis model of the gas turbine blade for which boundary conditions have been set based on operating conditions of the gas turbine, the boundary conditions for the heat transfer analysis being one of thermal conditions including gas temperature, heat transfer coefficient, and heat radiation coefficient, and the boundary conditions for the structural analysis being one of loading conditions including pressure, centrifugal force, and acceleration; and making an angle between the direction of a longitudinal axis of the film cooling holes and the calculated direction of the principal strain less than or equal to 15 degrees;

making the direction of the longitudinal axis of the film cooling holes aligned with a span direction of the gas turbine blade when the direction of principal strain is within a range of 15 degrees from the span direction of the gas turbine blade; and making the direction of the longitudinal axis of the film cooling holes aligned with a chord direction of the gas turbine blade when the direction of principal strain is within a range of 15 degrees from the chord direction of the gas turbine blade; and wherein the gas turbine blade is made of a nickel-base superalloy having anisotropy and the film cooling holes having a noncircular elliptical shape at a surface of the gas turbine blade or a section parallel to the surface of the gas turbine blade.

2. A gas turbine blade having cooling holes formed by the method of claim 1.

3. The gas turbine blade according to claim 2, wherein a first area of the film cooling holes provided on the surface of the blade is greater than a second area of the film cooling holes provided on the surface of a cooling pass formed inside the blade.

4. The gas turbine blade according to claim 2, wherein a plurality of the cooling holes are provided in the span direction in a leading edge portion or trailing edge portion of the blade.

5. The gas turbine blade according to claim 2, wherein a plurality of the cooling holes are arranged in the chord direction at a tip portion of the blade.

6. The gas turbine blade according to claim 2, wherein a plurality of the cooling holes are arranged in the span direction on a pressure side of the blade.

* * * * *